US005148553A

United States Patent [19]

Jermann

[11] Patent Number: 5,148,553

[45] Date of Patent: Sep. 22, 1992

[54] CHILD'S URINAL FOR HANGING ON SIDE OF TOILET

[76] Inventor: Frederic Jermann, 102 Bryan Ct., Apt. 201, Laurel, Md. 20707-4546

[21] Appl. No.: 741,076

[22] Filed: Aug. 6, 1991

[51] Int. Cl.[5] ..... A47K 11/12

[52] U.S. Cl. ..... 4/341; 4/144.1

[58] Field of Search ..... 4/114.1, 144.1, 144.2, 4/231, 252 A, 258, 260, 300.3, 301, 314, 340, 341, 342, 449, 479, DIG. 5

[56] References Cited

U.S. PATENT DOCUMENTS

| | | | |
|---|---|---|---|
| 182,257 | 9/1876 | Winton | 4/258 |
| 1,857,328 | 5/1932 | Piper | 4/144.1 |
| 3,422,463 | 1/1969 | Lowry | 4/144.1 |
| 3,466,145 | 9/1969 | Van Duyne | 4/449 X |
| 3,625,654 | 12/1971 | Van Duyne | 4/144.1 X |
| 3,929,412 | 12/1975 | Villari | 4/144.1 X |
| 4,137,573 | 2/1979 | Kroeger | 4/144.1 |
| 4,309,779 | 1/1982 | Knight | 4/144.1 X |
| 4,612,676 | 9/1986 | Whitman | 4/300.3 |
| 5,044,020 | 9/1991 | Lewandowski et al. | 4/301 |
| 5,060,317 | 10/1991 | Bertelsen | 4/144.2 |

FOREIGN PATENT DOCUMENTS

| | | | |
|---|---|---|---|
| 0000349 | of 1896 | United Kingdom | 4/258 |

*Primary Examiner*—Henry J. Recla
*Assistant Examiner*—Robert M. Fetsuga
*Attorney, Agent, or Firm*—Brady, O'Boyle & Gates

[57] ABSTRACT

A child's urinal for hanging on the outside of a toilet, wherein a basin having an integral back wall forming a splash wall is suspended from the side of a toilet, the back wall is dimensioned to positioned the basin in proximity to the floor adjacent the toilet to render the urinal accessible to a child. The basin and integral back wall can be detachable connected to a frame member suspended from the side of the toilet, and the frame member can include an adjustable feature for varying the position of the basin relative to the floor.

16 Claims, 5 Drawing Sheets

CHILD'S URINAL FOR HANGING ON SIDE OF TOILET

BACKGROUND OF THE INVENTION

Various training aids have been proposed to teach children, particularly, young boys, how to use a toilet in the same manner as an older boy or man might use a urinal. These training aids have consisted in various devices such as targets, paddle wheels and bowls to get the child interested in using the toilet as a urinal.

While these toilet attached training aids have been satisfactory for their intended purpose, they have been characterized by certain disadvantages, in that they are positioned inside the toilet bowl, and the edge of the standard toilet bowl is too high off the floor for the child to reach the training aid inside the bowl by himself while he is of a certain height. Such height is usually not attained until a child reaches approximately three or three-and-half years of age or older, resulting in the child loosing interest in such toilet training at an earlier age.

SUMMARY OF THE INVENTION

After considerable research and experimentation, the child's urinal of the present invention has been devised to overcome the disadvantages experienced in the prior art training aids, and comprises an open basin having an integral splash wall on the back portion thereof, and a hook portion integral with the top of the splash wall. The hook portion is adapted to extend over the top edge of a toilet bowl on one side, or the front, thereof, whereby the splash wall and associated basin are suspended on the outside of the toilet from the edge of the bowl, to thereby position the basin at a height above the floor, so that it is easily accessible to a small male child in a standing position, thus enhancing early interest in standing urination toilet training. The top of the open basin is well below the top edge of the toilet bowl; and for example, may be approximately six-and-one-half to seven inches from the floor. This means that a child could begin urination training in a standing position with the child's urinal of this invention beginning at approximately age two or two-and-one-half years old.

While the hook portion, splash wall, and basin may all be integral, only the basin and splash wall may be integral and insertable into a separate frame suspended from the side of the toilet bowl. The separate frame can also be provided with an adjustment feature, whereby the distance of the basin from the floor can be adjusted to accommodate the size of the child.

DESCRIPTION OF THE PREFERRED EMBODIMENTS

Figure 1:
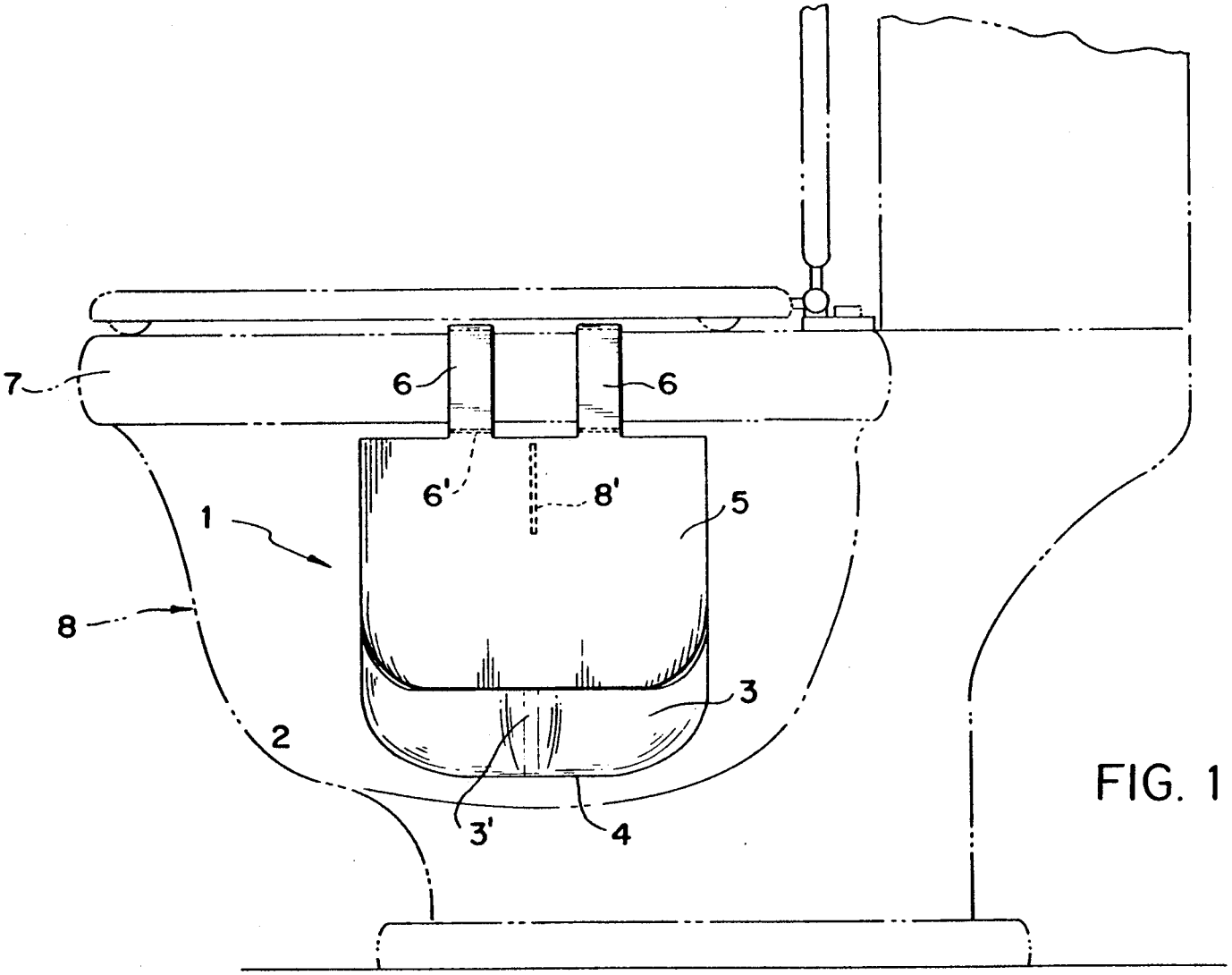
FIG. 1 is a front elevational view of one embodiment of the urinal of the present invention shown mounted on the outer side of a toilet bowl.
Figure 2:
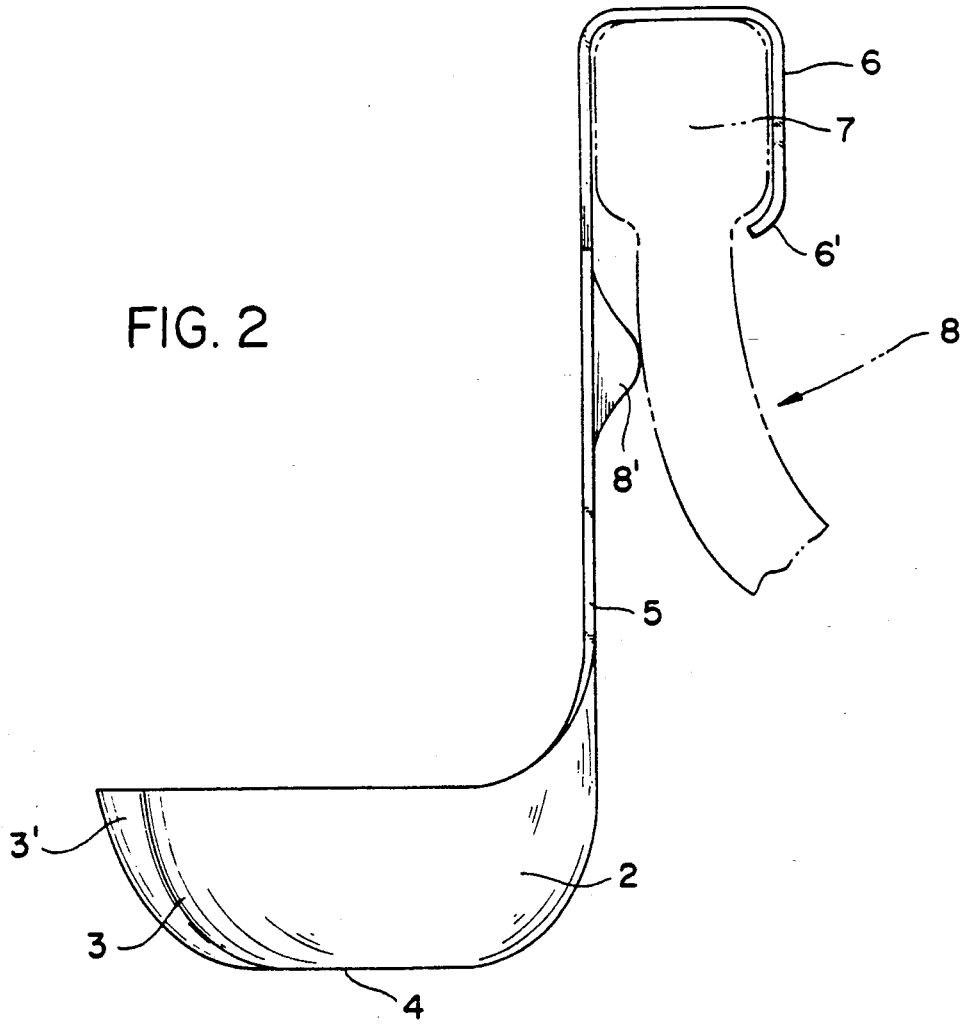
FIG. 2 is a side elevational view of the urinal shown in FIG. 1 and showing the top edge of a toilet bowl in phantom lines.
Figure 3:
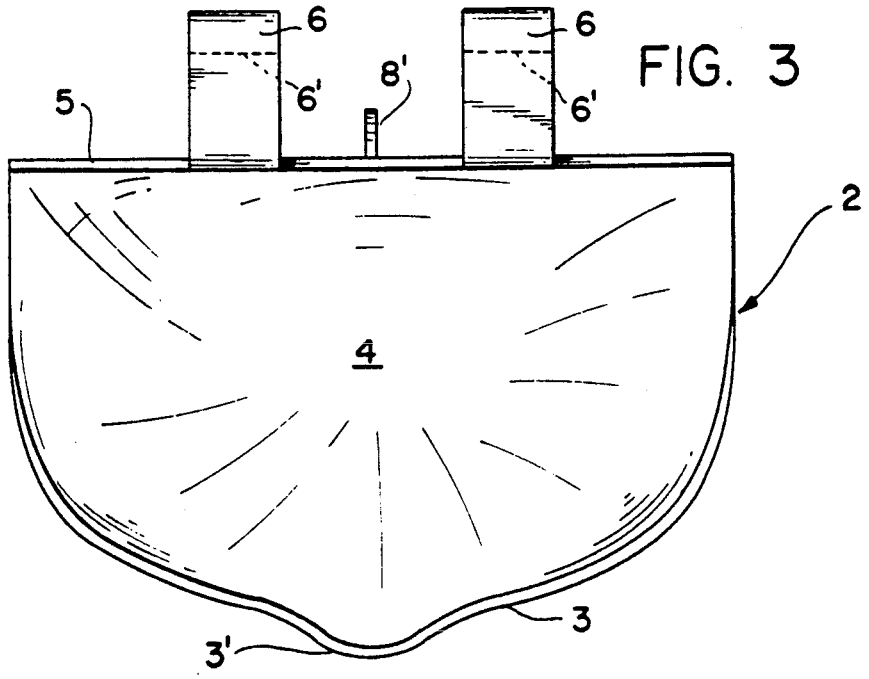
FIG. 3 is a top plan view of the urinal.

Referring to the drawings, and more particularly FIGS. 1, 2, and 3, the urinal 1 of the present invention comprises a basin portion 2 having a front wall 3, a bottom wall 4 and upwardly extending back wall means in the form of a back wall 5 having hook means in the form of a pair of integral hooks 6 on the upper end thereof, facing away from the basin portion 2. The center portion of front wall 3, may be formed to protrude somewhat outwardly toward the user, as shown at 3' to position the front edge of the basin portion closer to the standing child user. The back wall 5 provides a relatively high and broad splash wall, and the hooks 6 extend over the rim 7 of a toilet bowl 8, whereby the urinal 1 is suspended from the side of the toilet and on the outside of the toilet bowl. The free ends of the hooks 6 are curved slightly inwardly as indicated at 6' to engage under the bottom of the inside rim of the bowl rim 7, to aid in lateral stabilization of the urinal. In order to maintain the back wall 5 in a vertical plane, a protuberance 8' extends outwardly from the back surface of the back wall 5 and engages the outside surface of the toilet bowl 8 below the rim 7.

The urinal is preferably of unitary construction and molded of plastics material. The thickness of the material forming the hooks 6 is such that the hooks do not interfere with the toilet seat, since they fit in the vertical space between the top rim 7 and the bottom of the toilet seat provided by the toilet seat bumpers, as shown in FIG. 1. With the urinal in place on the outside of the toilet bowl, the toilet seat and lid may be lowered with no interference from hooks 6. The urinal can thus remain in position on the outer side of the toilet and does not interfere with the use of the toilet by adults.

By the construction and arrangement of the urinal 1, the basin 2 is positioned at a height above the floor to render the urinal readily accessible to a child. The top rim 7 of a toilet bowl 8 is generally approximately fifteen inches above the floor. The open top edge of the basin portion 2 may, for example, only be positioned approximately six-and-one-half to seven inches above the floor, while the bottom wall 4 of the basin portion 2 may be four to five inches above the floor with the basin having a depth of approximately two-and-one-half to three inches. After use, the urinal can be removed as a unit from the toilet 8, washed, and replaced to the position shown in FIG. 1.

Figure 4:
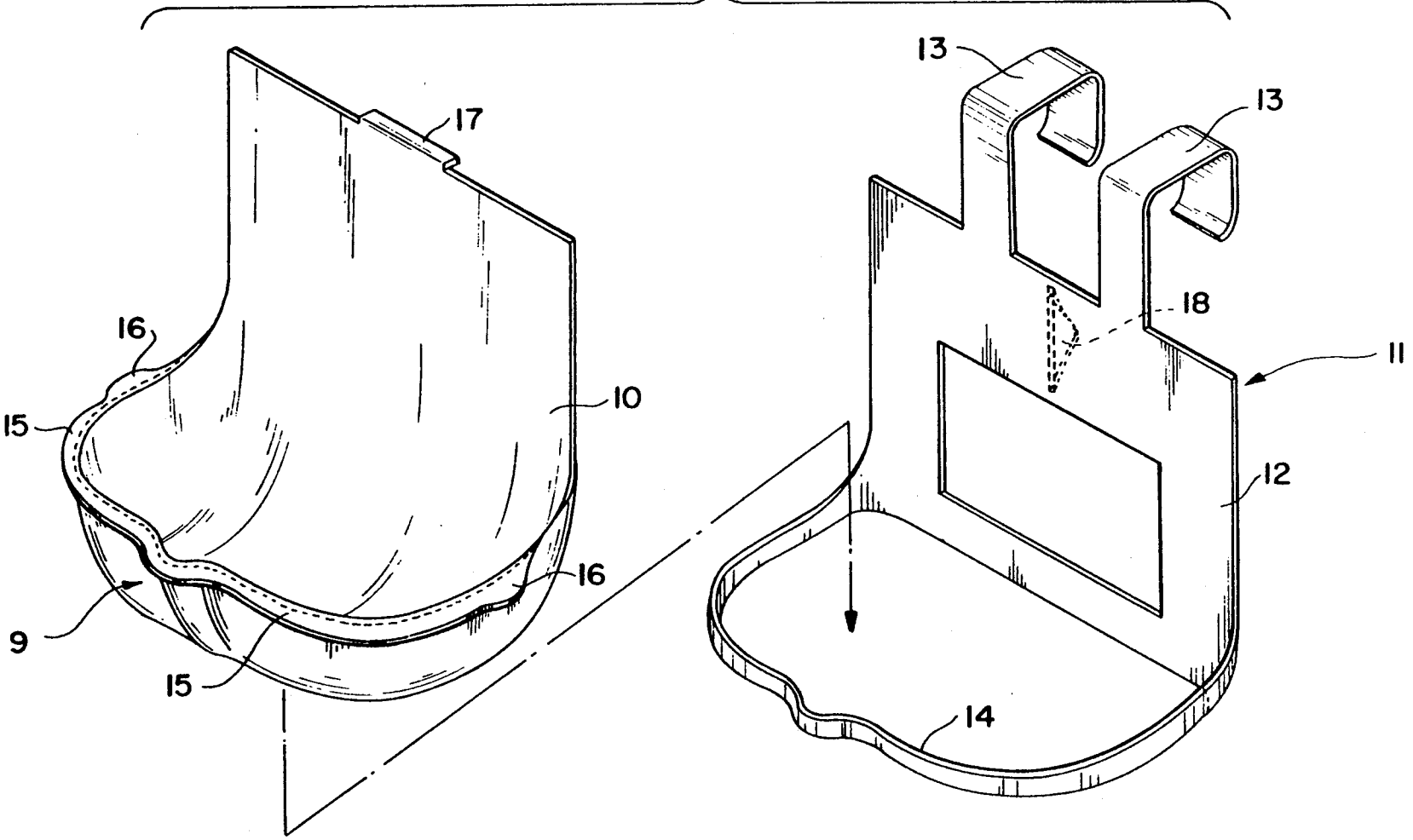
FIG. 4 is an exploded, perspective view of another embodiment of the present invention, wherein an integral basin portion and splash wall are detachably connected to a frame member.
Figure 5:
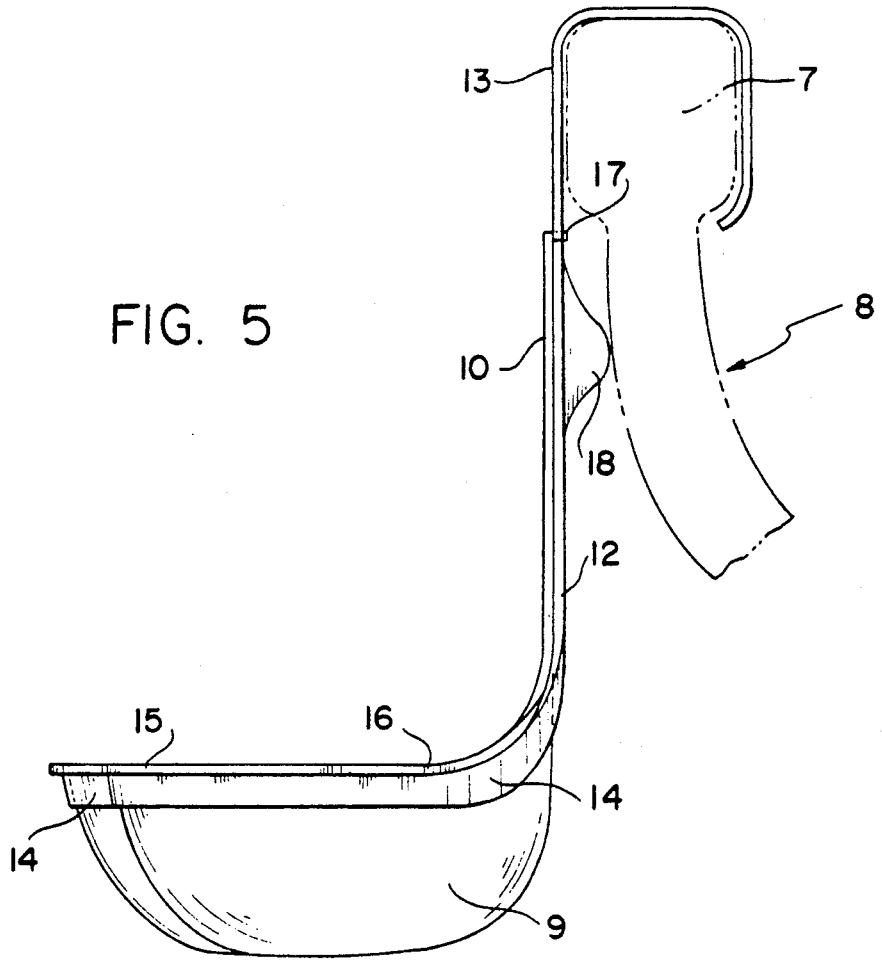
FIG. 5 is a side elevational view of the assembled urinal shown in FIG. 4.
Figure 6:
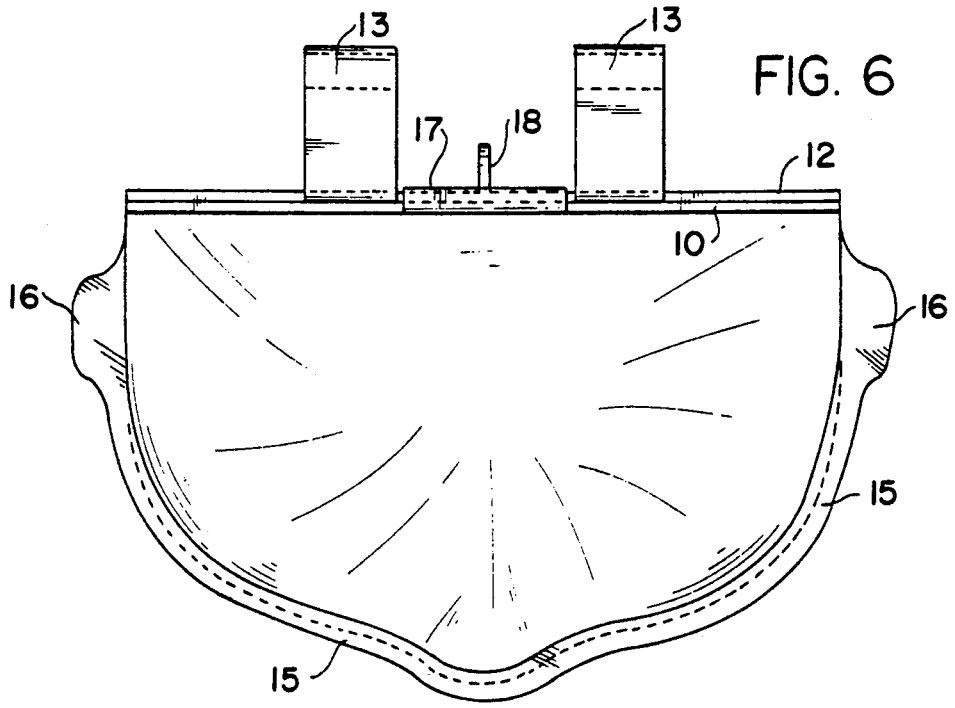
FIG. 6 is a top plan view of the urinal shown in FIG. 5.

FIGS. 4, 5, and 6 illustrate another embodiment of the invention, wherein the basin portion 9 and splash wall 10 are integral and insertable into and removable from a separate frame member 11 having a back wall 12 provided with hook means in the form of spaced hooks 13 on the upper edge thereof, and an arcuate hoop or rim 14 extending outwardly from the lower edge thereof. The splash wall 10 and back wall 12 collectively defining back wall means. The top edge of the basin portion 9 is provided with a lip or flange portion 15 configured to correspond to the rim 14, whereby the basin portion 9 is insertable into the rim 14 and supported therein by the flange portion 15 engaging the top of the rim 14. The basin flange portion 15 is also provided with enlarged finger grasping portions 16 on opposite sides of the basin portion to facilitate the manual removal of the basin 9 and associated splash wall 10 from the frame member 11 for emptying and cleaning. The upper edge of the splash wall 10 is provided with guide means in the form of a flange member 17 which extends over the top edge of the back wall 12 of the frame and between the hooks 13 to serve as a guide and for providing stability. A protuberance 18 is also provided on the back surface of the frame wall 12 which is engageable with the toilet bowl 8 to maintain the frame member 11 and splash wall 10 in a substantially vertical plane, and, accordingly, the basin 9 in a substantially horizontal plane.

Figure 7:
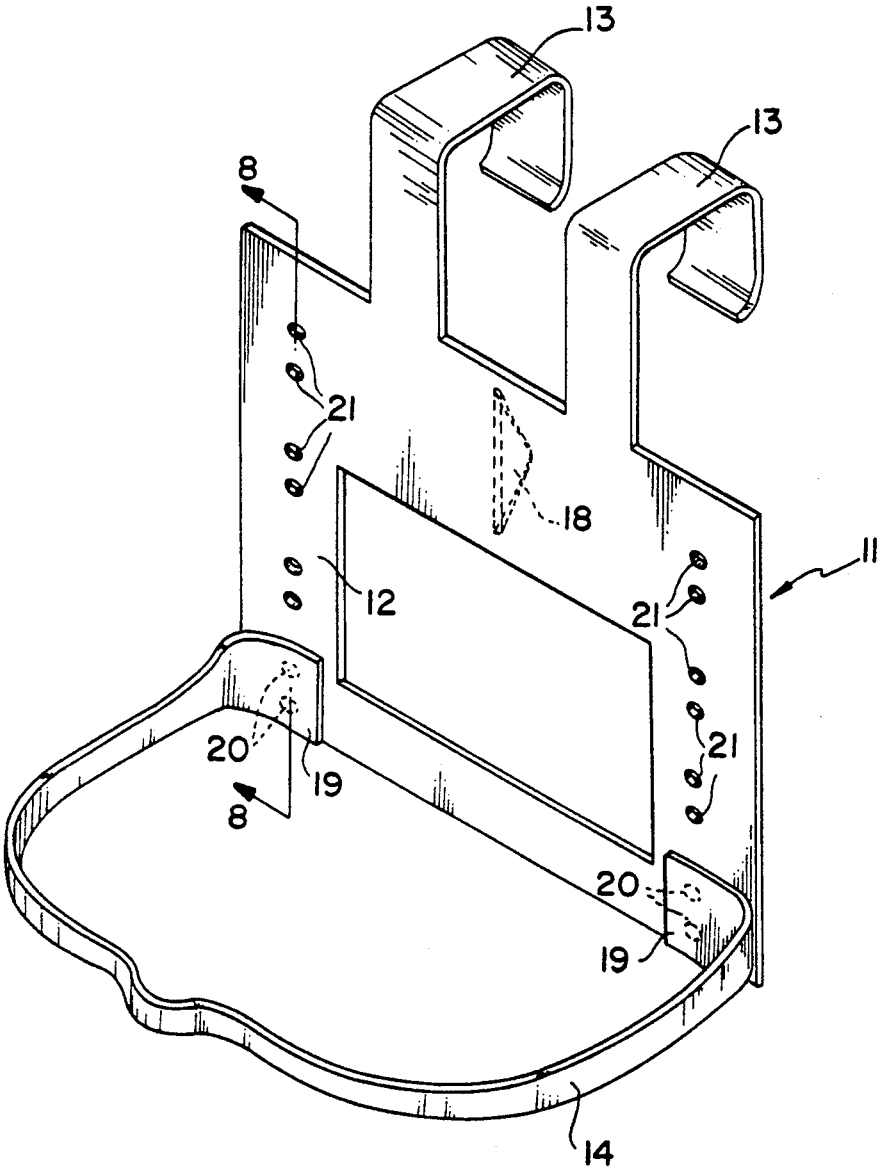
FIG. 7 is a perspective view of another embodiment of the frame member shown in FIG. 4.
Figure 8:
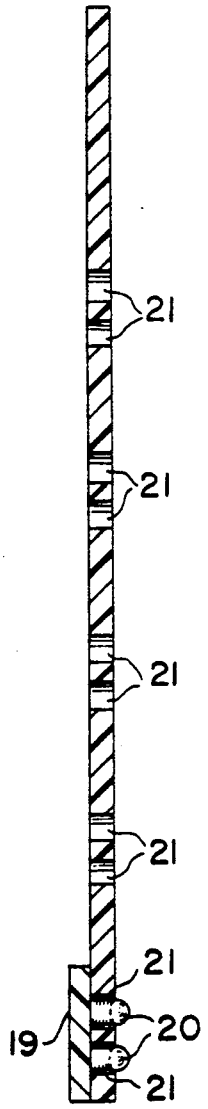
FIG. 8 is a vertical section view taken along line 8—8 of FIG. 7.

Another embodiment of the frame 11 is shown in FIG. 7, wherein the rim 14 is formed as a separate element from back wall 12, and is provided with inwardly turned end portions 19 having button means thereon in the form of integrally molded buttons 20, extending rearwardly therefrom. Buttons 20 are stud members with enlarged head portions and are insertable by snap-type action into selected pairs of vertically spaced apertures 21 provided in the frame back wall 12. Apertures 21 are slightly smaller in diameter than the head portions of buttons 20, and since the members are constructed of yieldable material, the buttons 20 can be readily inserted in the apertures 21 to provide firm anchoring for the rim 14, and be readily removed therefrom. The buttons 20 and apertures 21 collectively defining connecting means. By this construction and arrangement, the rim 14 can be adjusted vertically, in approximate one inch increments, whereby the distance of the basin 9 from the floor can be adjusted to accommodate the size of the child, and the growing size of the child. The integral basin portion 9 with flange portions 15, 16 and splash wall 10, as shown in FIGS. 4–6, is insertable in the adjustable rim 14.

It is to be understood that other forms of adjustable connecting means, other than the buttons 20 and apertures 21 shown, can be utilized, and the connecting means can be reversed on the respective members. Buttons having larger heads can be utilized which fit into keyhole-shaped apertures in place of apertures 21, as shown. The apertures 21, in either case, can be arranged in a different pattern than shown for providing the vertical adjustment.

From the above description it will be appreciated by those skilled in the art that the child's urinal of the present invention is an improvement over prior art training devices since it is more realistically accessible to the male child. The urinal can be made of various molded material, such as plastic or bio-degradable paper.

The terms and expression which have been employed herein are used as terms of description and not of limitation, and there is no intention, in the use of such terms and expressions, of excluding any equivalents of the features shown and described or portions thereof, but it is recognized that various modifications are possible within the scope of the invention claimed.

I claim:

1. In combination with a toilet bowl having an upper rim with an inner wall and an outer wall, a child's urinal depending from the upper rim on the outside of the toilet bowl adapted for urination training of a child comprising, a basin portion having a front wall, a bottom wall and back wall means for forming a splash wall and extending upwardly in a substantially vertical plane from said bottom wall, said back wall means having an upper end in contact with the outer wall of the upper rim, hook means on the upper end of said back wall means for freely suspending said urinal from said upper rim, said hook means extending opposite to said basin portion, said hook means having a first portion extending from said back wall means over the upper rim toward the inside of said toilet bowl and a second portion connected to said first portion and extending downwardly along the inner wall of said upper rim, and the height of the back wall means being dimensioned so said basin portion is suspended on the outside of the toilet in proximity to the floor supporting the toilet, to thereby render the urinal accessible to a child too small to urinate over the upper rim of the toilet bowl.

2. A child's urinal according to claim 1, wherein said upper end of said back wall means having a top edge, said hook means comprises a pair of spaced hooks integral with the top edge of the back wall means.

3. A child's urinal according to claim 1, wherein a protuberance is provided on the back surface of the back wall means, said protuberance engageable with the outside of the toilet bowl in proximity to and below the upper rim thereof, whereby the back wall means is maintained in a substantially vertical plane.

4. A child's urinal according to claim 1, in which said back wall means comprises a forward back splash wall juxtaposed in overlying relation to a back frame wall, said back frame wall including said upper end, said hook means being integral with said upper end, a frame member including said back frame wall and having a rim extending outwardly from the back frame wall below said hook means, said basin portion being integral with said forward back splash wall, a flange provided on the edge of the basin portion configured to correspond to the rim, whereby the integral basin portion and forward back splash wall is insertable into the rim and supported therein by the flange engaging the rim.

5. A child's urinal according to claim 4, wherein a protuberance is provided on the back surface of the back frame wall and is engageable with the toilet bowl in proximity to the rim thereof, whereby the frame member and associate forward back splash wall are maintained in a vertical plane while the basin portion is maintained in substantially a horizontal plane.

6. A child's urinal according claim 4, wherein the flange of the basin portion is provided with finger engaging portions to facilitate manually removing the basin and associated forward back splash wall from the frame member.

7. A child's urinal according to claim 4, including cooperating connecting means on said rim and said back frame wall for selective vertical adjustment of said rim on said back frame wall.

8. A child's urinal according to claim 4, in which said back frame wall and said forward back splash wall are substantially coextensive.

9. A child's urinal according to claim 4, wherein each end of the rim is provided with inwardly turned end portions, button means integral with the inwardly turned end portions and extending rearwardly therefrom for releasably connecting said rim to said back frame wall, a plurality of vertically spaced apertures provided in the back frame wall, said button means being inserted into selected apertures of said plurality of spaced apertures, whereby the rim can be adjusted vertically, to thereby adjust the distance of the associated basin from the floor to thereby accommodate children of various sizes.

10. A child's urinal according to claim 9, in which said button means comprise stud members having enlarged head portions.

11. A child's urinal according to claim 4, in which said hook means comprises a pair of spaced hooks.

12. A child's urinal according to claim 11, in which said pair of spaced hooks have inwardly bent free end portions.

13. A child's urinal according to claim 11, in which said forward back splash wall includes an upper edge adjacent said upper end of said back frame wall, and guide means connected to said upper edge of said forward back splash wall extending between said pair of spaced hooks of said back frame wall.

14. A child's urinal according to claim 4, in which said hook means and said rim extend in opposite directions from said frame member.

15. A child's urinal according to claim 1, in which said second portion of said hook means have inwardly extending free end portions directed toward said back wall means.

16. A child's urinal according to claim 1, in which said basin portion front wall has a top rim and is relatively shallow in depth, and said back wall means extends a substantial distance above said top rim of said basin portion to form said splash wall.

* * * * *